US005671725A

United States Patent [19]

Dishaw

[11] Patent Number: 5,671,725

[45] Date of Patent: Sep. 30, 1997

[54] BRICK AND BLOCK WALL REPAIR DEVICE

[76] Inventor: Robert J. Dishaw, P.O. Box 398, South Colton, N.Y. 13687

[21] Appl. No.: 536,389

[22] Filed: Sep. 29, 1995

[51] Int. Cl.[6] ..... B28D 1/08

[52] U.S. Cl. ..... 125/21; 125/22

[58] Field of Search ..... 451/298; 125/21, 125/22

[56] References Cited

U.S. PATENT DOCUMENTS

| | | | |
|---|---|---|---|
| 2,869,534 | 1/1959 | Stihl | 125/21 |
| 3,545,422 | 12/1970 | McNulty | 125/21 |
| 3,593,700 | 7/1971 | McNulty | 125/21 |
| 4,920,947 | 5/1990 | Scott et al. | 125/22 |
| 5,123,400 | 6/1992 | Edgerton | 83/830 |
| 5,136,783 | 8/1992 | Bell et al. | 125/21 |
| 5,184,598 | 2/1993 | Bell | 125/21 |

*Primary Examiner*—Eileen P. Morgan

[57] ABSTRACT

A brick and block wall repair device comprising: a chain saw blade formed in a planar configuration with a continuous outer edge including a slidable device, the blade being operatively coupled to the motor of a chain saw in the operative orientation, the blade having the appropriate height to fit within the mortar joints of a brick and block structure, the rotation mechanism of the motor causing the guide bar to revolve around the edge of the blade in the operative orientation; and a cutter chain consisting of at least one row of cutter teeth, each of the teeth having a linear first end and a tooth second end, the first end of each of the teeth being coupled to the chain saw blade, the chain having the appropriate width to fit within the mortar joints of a brick and block structure, the tooth second end having a rough surface to facilitate the severing of brick, block, mortar and the like.

1 Claim, 8 Drawing Sheets

FIG 3
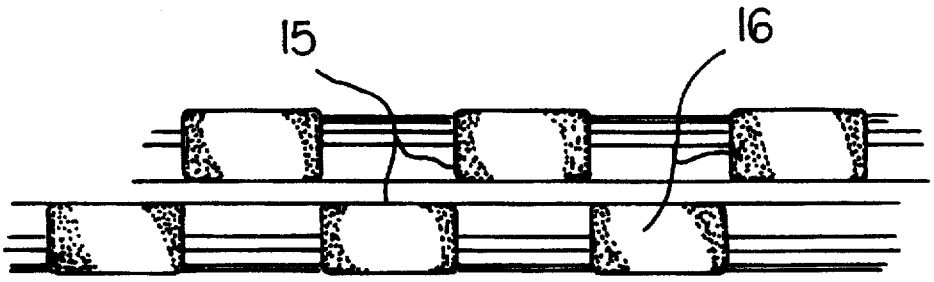
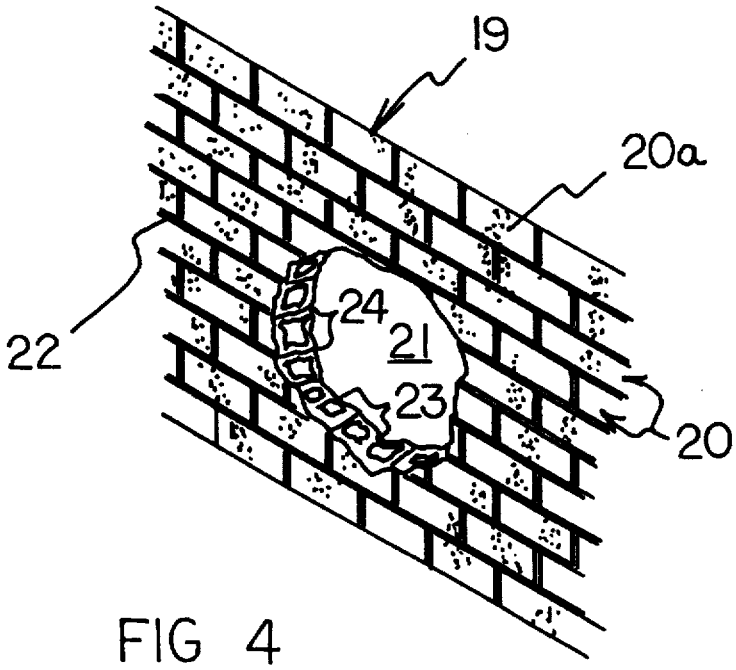
FIG 4

FIG 11
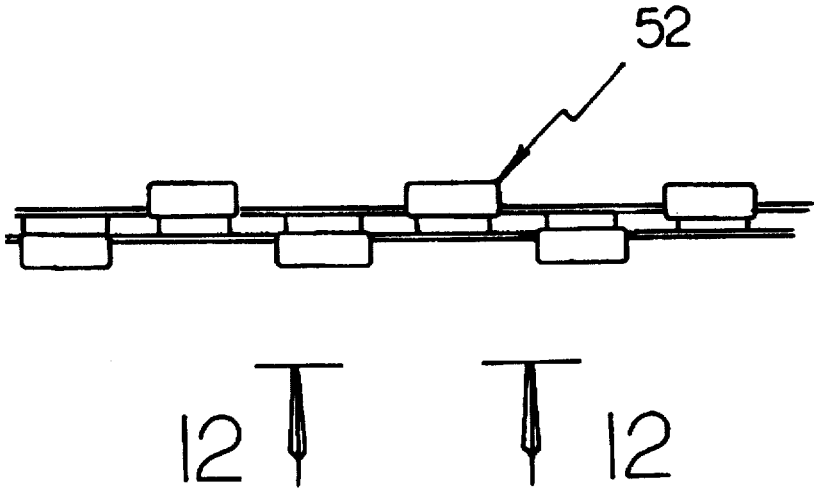
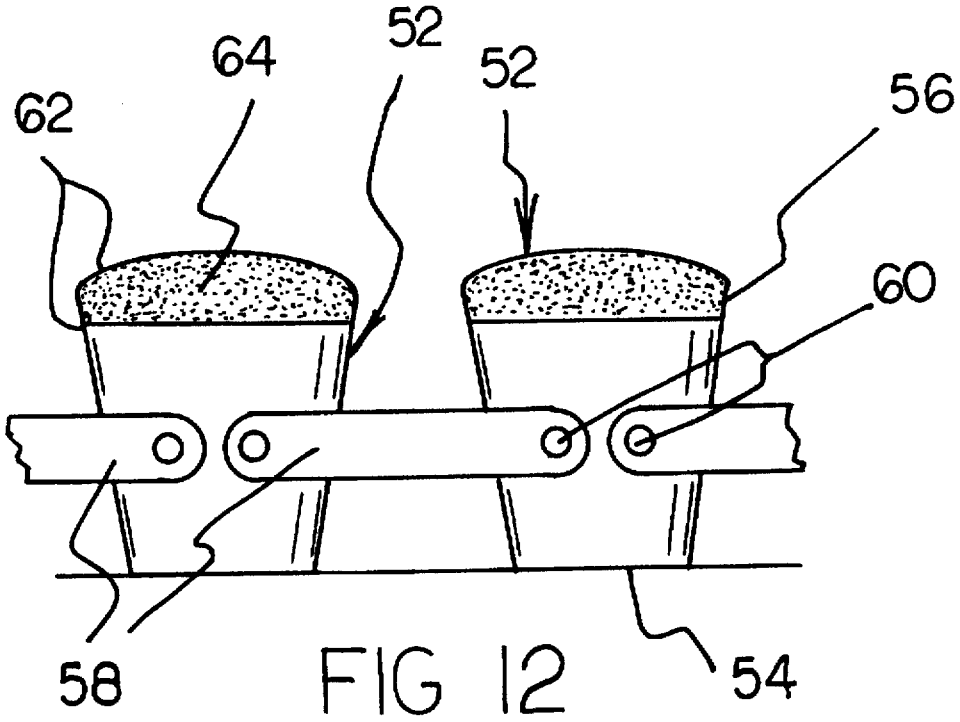
FIG 12

BRICK AND BLOCK WALL REPAIR DEVICE

BACKGROUND OF THE INVENTION

1. Field of the Invention

The field of invention relates to a brick repair apparatus, and more particularly pertains to a new and improved brick and block wall repair device wherein the same is arranged to repair brick and block wall structure employing a chain saw assembly minimizing damage to the wall in removal of brick segments therefrom.

2. Description of the Prior Art

Prior art structure employed in brick and block repair may be found in U.S. Pat. No. 3,545,422 to McNulty wherein a chain saw structure is provided for the cutting of reinforced concrete.

U.S. Pat. Nos. 4,899,720; 3,593,700; and 4,986,252 are further examples of chain saw structure arranged for the severing of brick and cementeous materials.

Accordingly, it may be appreciated there continues to be a need for a new and improved brick and block wall repair device as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of wall repair method and apparatus therefore now present in the prior art, the present invention provides a brick and block wall repair device wherein the same is arranged to employ a chain saw structure to remove brick segments in adjacency to an opening for repair relative to a brick wall structure. As such, the general purpose of the present invention, which will be described subsequently in greater detail, is to provide a new and improved brick and block wall repair device which has all the advantages of the prior art mortar repair apparatus and methods and none of the disadvantages.

To attain this, the present invention provides a chain saw structure including plural rows of offset diamond grid teeth arranged to effect notching and removal of brick segments projecting into and in communication with an opening for repairing a brick wall. The segments are notched along the mortar line of the wall permitting replacement of uniformly shaped members for repair of the brick wall.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved brick and block wall repair device which has all the advantages of the prior art brick and block method and apparatus therefore and none of the disadvantages.

It is another object of the present invention to provide a new and improved brick and block wall repair device which may be easily and efficiently manufactured and marketed.

It is a further object of the present invention to provide a new and improved brick and block wall repair device which is of a durable and reliable construction.

An even further object of the present invention is to provide a new and improved brick and block wall repair device which is susceptible of a low cost of manufacture with regard to both materials and labor, and which accordingly is then susceptible of low prices of sale to the consuming public, thereby making such brick and block wall repair devices economically available to the buying public.

Still yet another object of the present invention is to provide a new and improved brick and block wall repair device which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is an orthographic view, taken along the lines 3—3 of FIG. 1 in the direction indicated by the arrows.

FIG. 4 is an isometric illustration of a wall structure for repair.

FIG. 11 is a top plan view of the blade shown in FIG. 10.

FIG. 12 is a perspective view of two trapezoidal cutter teeth and their associated connecting shafts.

DESCRIPTION OF THE PREFERRED EMBODIMENT

Figure 1:
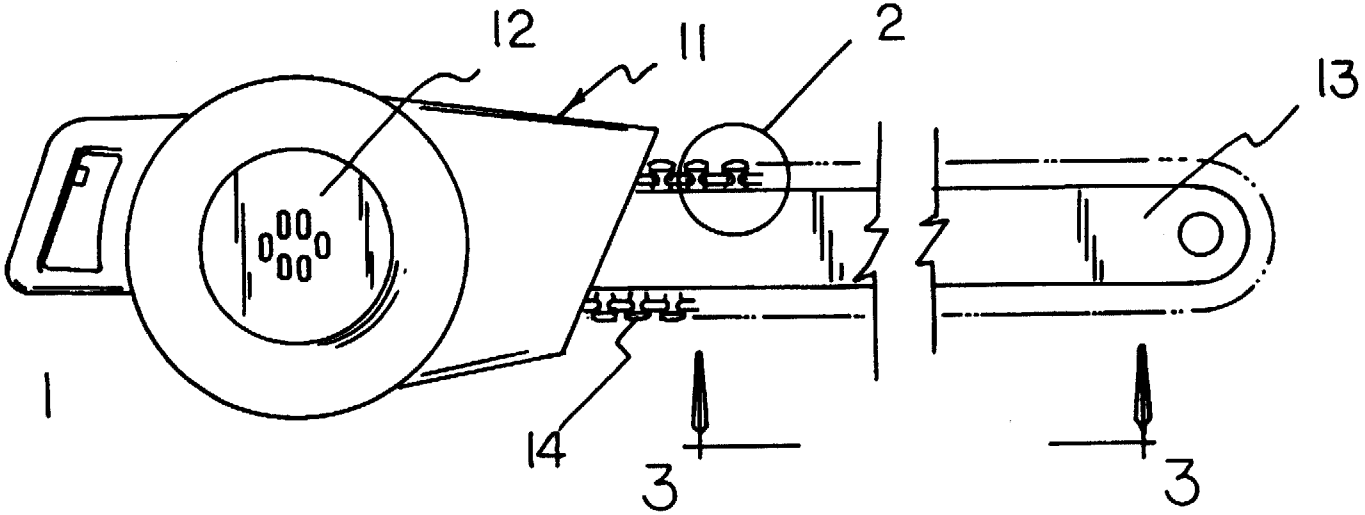
FIG. 1 is an orthographic view of the chain saw structure employed by the invention.

With reference now to the drawings, and in particular to FIGS. 1 to 16 thereof, a new and improved brick and block wall repair device embodying the principles and concepts of the present invention and generally designated by the reference numerals 11–64 will be described.

Figure 2:
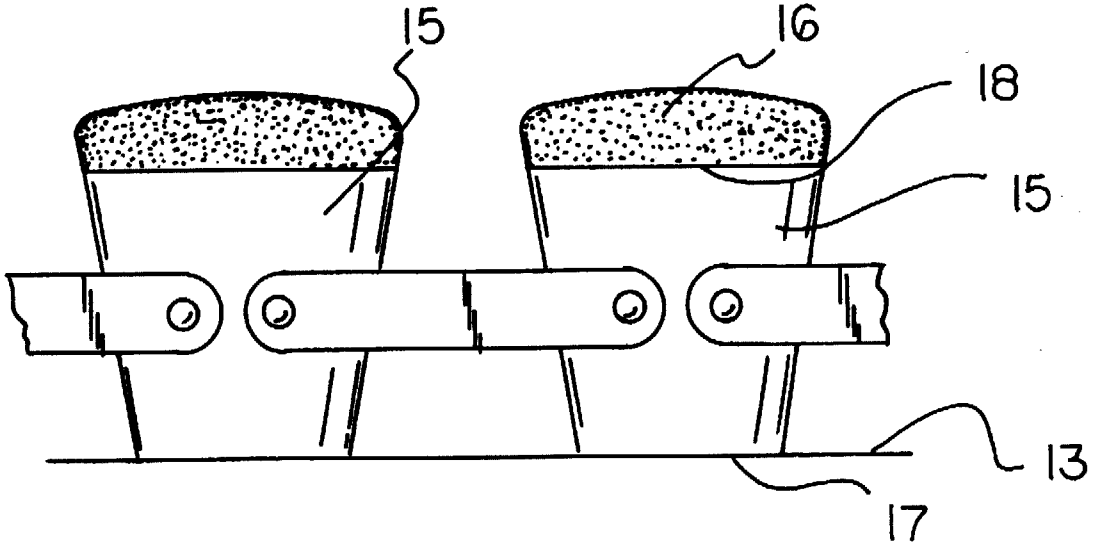
FIG. 2 is an enlarged orthographic view of section 2 as set forth in FIG. 1.
Figure 6:
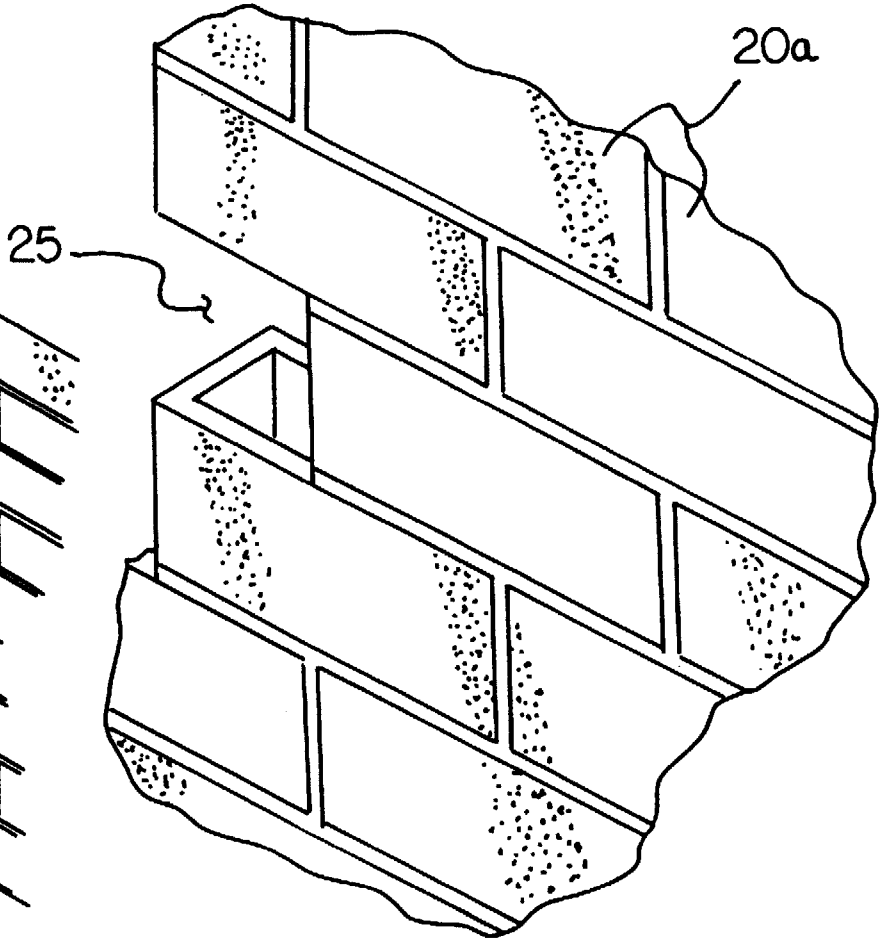
FIG. 6 is isometric illustration of the wall structure having not, directed therein from the wall opening.

More specifically, the brick and block wall repair device comprises the provision of a chain saw assembly 11, as indicated in FIG. 1, having a handle mounted to a housing, with the housing including a drive motor 12 in operative communication with a cutter chain 14 directed about a guide bar 13. The cutter chain 14 includes plural rows of offset trapezoidal cutter teeth 15 (see FIGS. 2 and 3), wherein each of the cutter teeth include a first end 17 guided in adjacency and along the guide bar 13. A tooth second end 18 includes a cap having a diamond grid surface 16, in a manner as indicated in FIG. 2, for the severing of brick, block, mortar, and the like.

An exemplary brick wall 19 is indicated in FIG. 4. The terminology "brick" is employed for purposes of brevity, but it is understood that any decorative structure to include masonry block, stone, and the like is encompassed by the invention. The brick wall 19 is formed, as indicated in FIG. 4, by plural brick rows 20 of individual bricks 20*a*. A brick wall opening 21 is indicated for repair, with the brick wall opening 21 having wall opening perimeter brick segments 23 in adjacency in communication with the opening 21. Brick mortar 22 is directed between the adjacent bricks 20*a*, as well as the segments 23.

Figure 5:
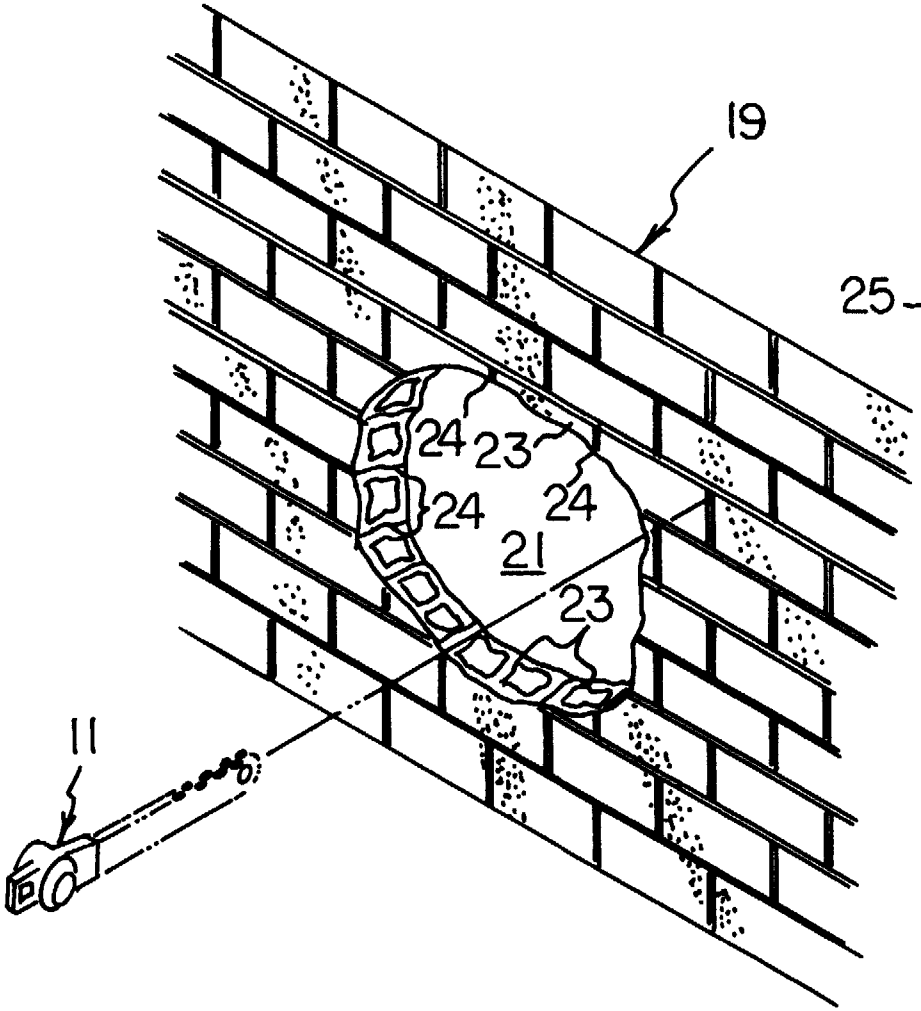
FIG. 5 is an isometric illustration of the wall structure employing the chain saw structure as set forth in FIG. 1.
Figure 8:
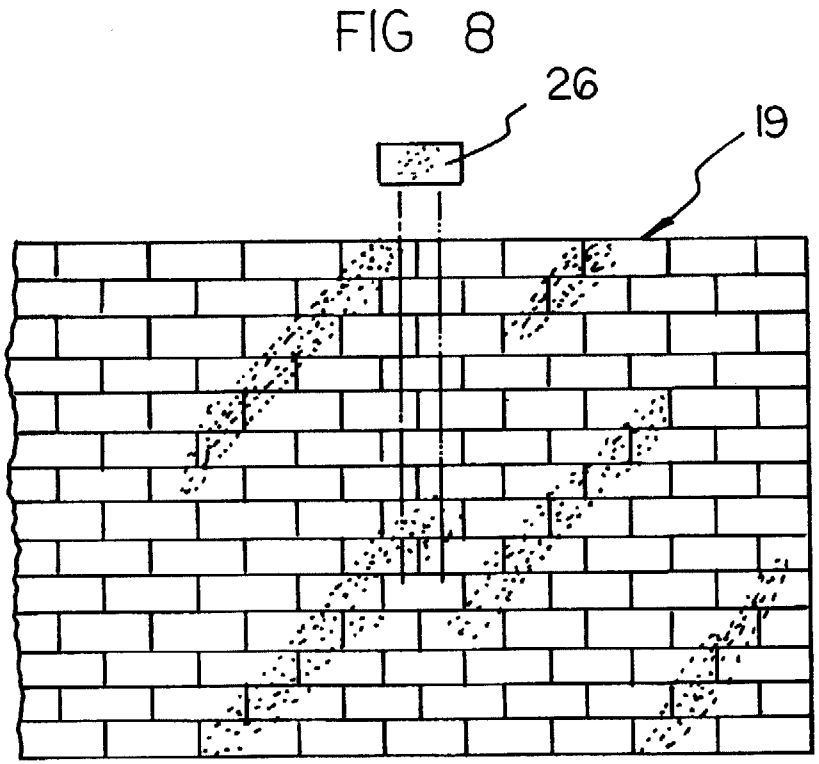
FIG. 8 is an orthographic view of the brick wall structure subsequent to repair.
Figure 7:
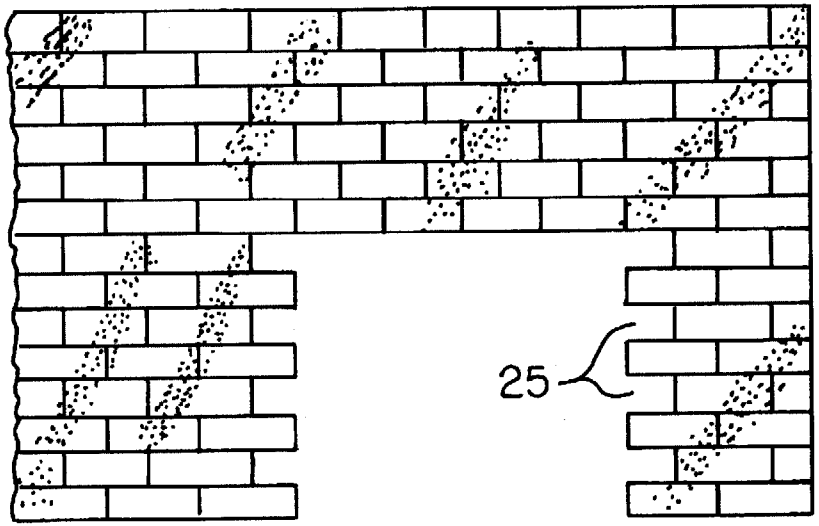
FIG. 7 is an orthographic view of an exemplary wall structure having the brick segments removed therefrom.
Figure 9:
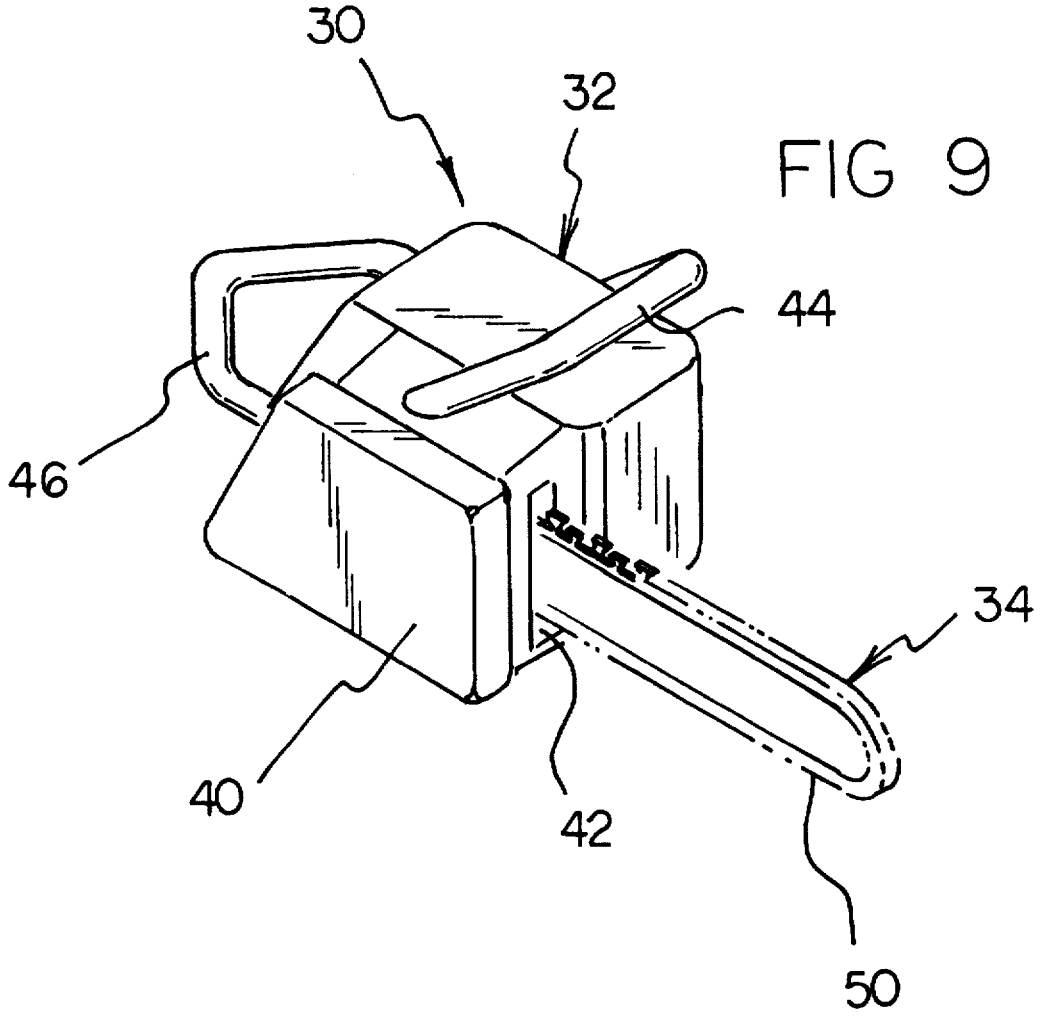
FIG. 9 is a perspective view of the chain saw structure employed by the invention.
Figure 10:
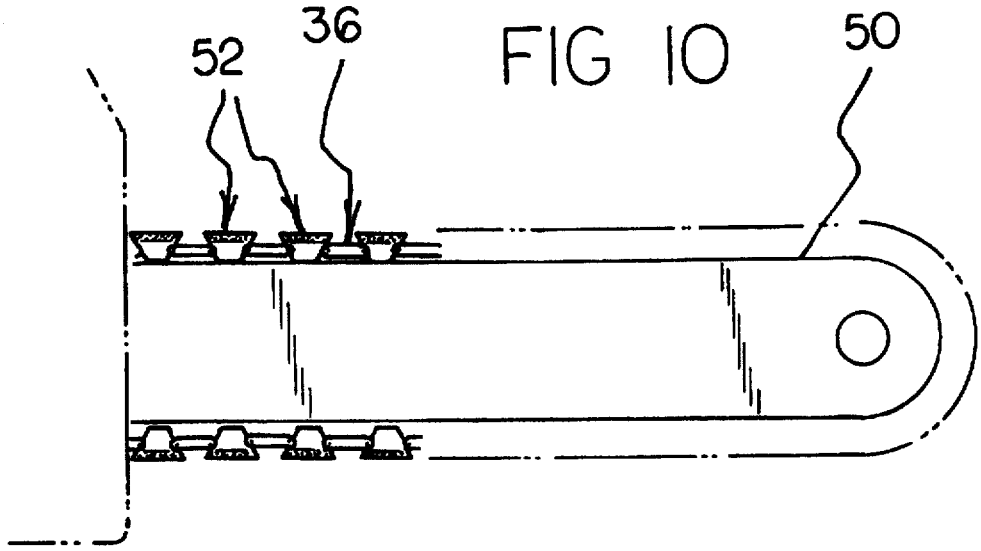
FIG. 10 is an isolated side perspective view of the blade of the apparatus shown in FIG. 9.
Figure 13:
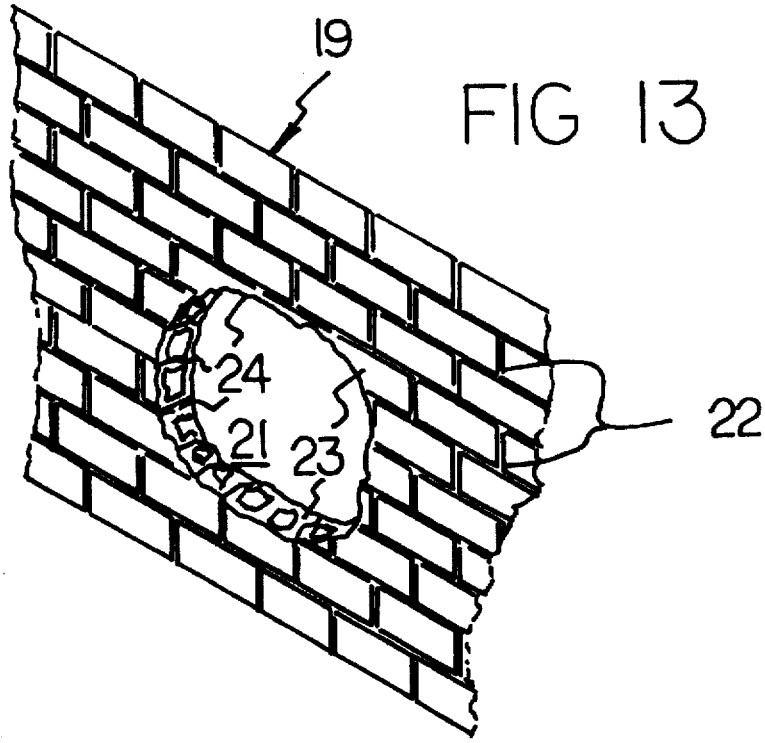
FIG. 13 is a perspective view of a wall structure for repair.

The FIG. 5 indicates the use of the chain saw assembly 11 directed along the brick mortar 22 between the brick segments 23 to remove the brick segments and have remaining the thusly formed wall opening parallelpipped notches 25 to receive replacement bricks 26 (see FIGS. 7 and 8) for repair of the wall opening.

Employment of the chain saw assembly permits the surgical removal of only those portions of the brick wall relative to the wall opening required to permit the insertion of the unitary replacement bricks for a repaired wall not limited in strength due to the wall opening. Such method may be further directed relative to the installation of a door or window frame relative to the opening structure 21, wherein merely the brick segments 23 as noted above are removed relative to a window or door framework to be inserted within the opening 21.

The chain saw 32 includes a housing 40 formed as a generally rectangular shaped box with an essentially hollow interior. The housing includes an aperture 42 extending therein. The housing includes an upper handle 44 and a rear handle 46. The handles provide the user with a secure gripping to manipulate the chain saw during use. The interior of the housing includes an electrically powered drive motor having rotation means. In alternative embodiments of the apparatus the drive motor is either gas or electrically powered. Note FIG. 9.

Figure 14:
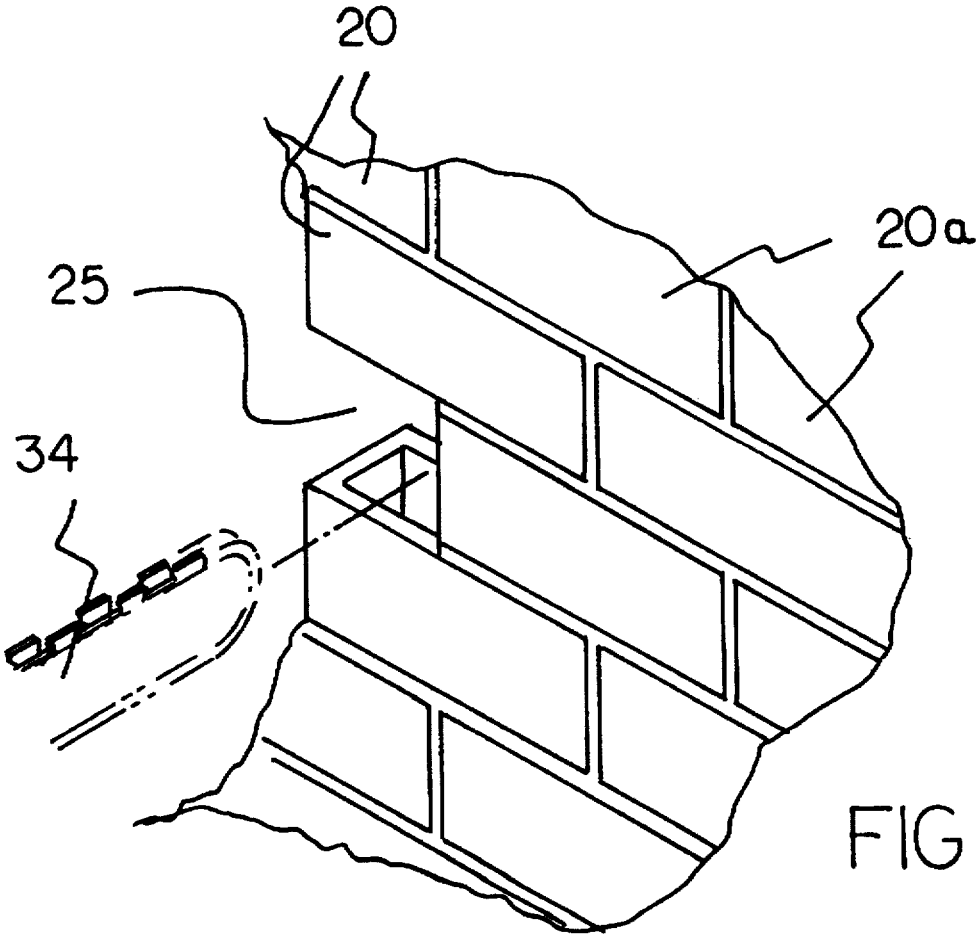
FIG. 14 is an isometric illustration of the wall structure having notches directed therein from the wall opening and employing the chain saw structure as set forth in FIG. 9.
Figure 15:
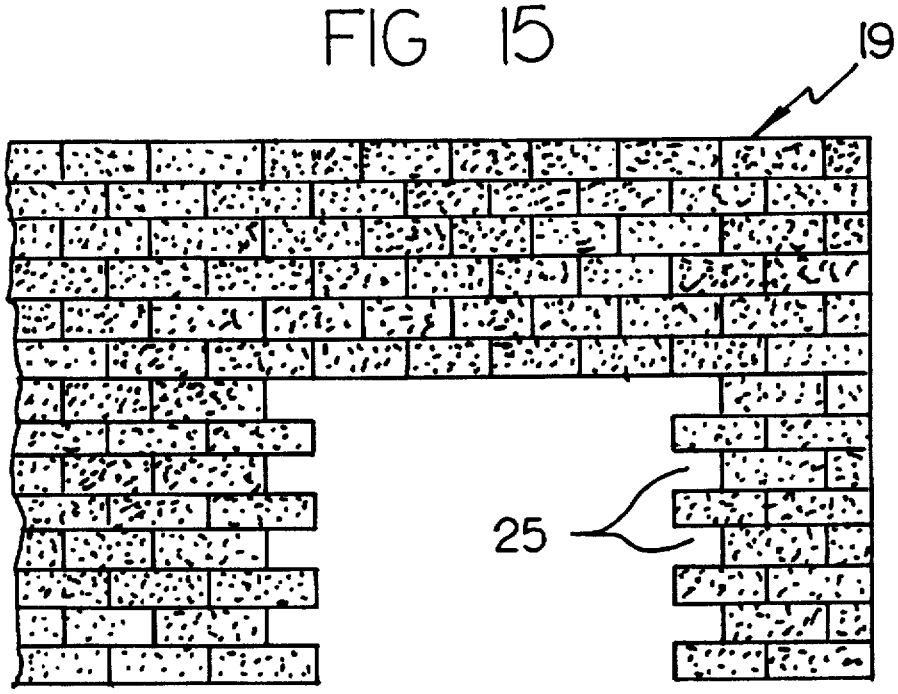
FIG. 15 is an perspective view of an exemplary wall structure having the brick segments removed therefrom.
Figure 16:
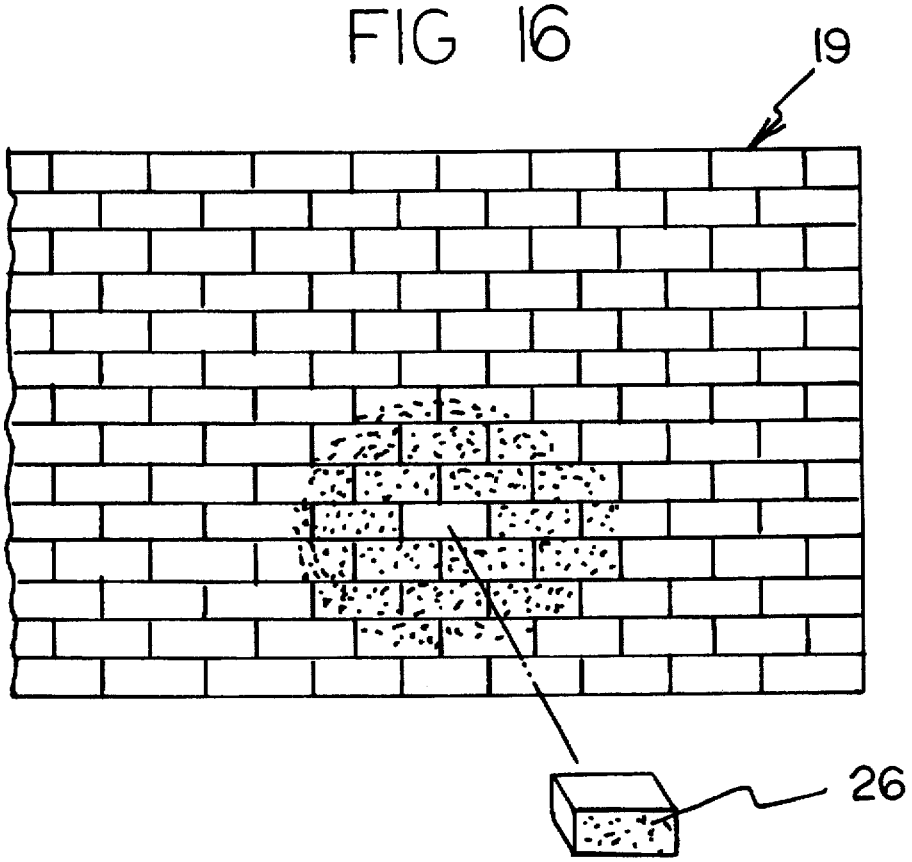
FIG. 16 is an perspective view of the brick wall structure subsequent to repair.

A chain saw blade 34 is formed in a planar generally oval shaped configuration with a continuous outer edge. The blade is about eight and one half inches in length and about two and one half inches in height. The height of the blade conforms to the height of a standard brick. FIG. 14 illustrates an exemplary brick wall formed of plural brick rows 20 of individual bricks 20*a*. FIG. 14 further illustrates the size of the blade relative to the parallel piped notches 25 which are adapted to receive replacement bricks 26. The height and width of the blade permit the user to remove mortar 22 from between bricks without damaging adjacent bricks. This feature is particularly useful to a user when performing minor repairs or installing window frames, doors, etc. Note FIGS. 13–16.

A guide bar 50 is formed in a thin planar rectangular configuration that is slidably coupled around the outer edge of the blade. The blade 34 is operatively coupled to the drive motor through the aperture 42 in the housing. The rotation means of the motor causes the guide bar to revolve around the edge of the blade in an operative orientation. The high speed of the revolving guide bar and cooperatively coupled cutter chain facilitates the severing of brick, block mortar, and the like. Note FIGS. 9 and 10.

A cutter chain 36 consists of parallel rows of offset cutter teeth 52. Each of the teeth is formed in a generally trapezoidal configuration with a linear first end 54 and a tooth second end 56. The linear first end of each of the teeth is coupled to the guide bar 50 of the chain saw blade. The cutter chain may be easily coupled or uncoupled from the chain saw blade when desired by the user. Note FIGS. 11 and 12.

A plurality of connecting shafts 58 are formed in a planar configuration with coupling means 60 at each end. The connecting shafts couple adjacent teeth to each other. The connecting shafts provide the apparatus with additional strength and durability. The connecting rods are particularly important given the offset teeth of the chain. The connecting rods fill the gaps between the teeth thereby providing the chain with the strength necessary to cut masonry while at the same time preventing binding of the blade. Note FIGS. 11 and 12.

The tooth second end includes a cap 62 having a diamond grid surface 64. The diamond grid surface facilitates the cutting of mortar. Since diamond is a much harder material than brick or mortar, the diamond grid teeth easily cut through masonry when traveling at high speeds around the blade. The width of each of the teeth is approximately one-eighth of an inch. The cutter blade is approximately one-quarter of an inch wide to permit users to easily cut through mortar joints. The offset teeth prevent the blade from binding while in use. Note FIGS. 10–12. As clearly disclosed in FIG. 12, each cap has front and rear edges which are beveled outwardly and upwardly to define a continuation of front and rear edges of the teeth.

As to the manner of usage and operation of the instant invention, the same should be apparent from the above disclosure, and accordingly no further discussion relating to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A new and improved brick and block wall repair device comprising, in combination:

a chain saw including a housing formed as a generally rectangular shaped box with an essentially hollow interior, the housing including an aperture extending therein, the housing including an upper handle and a rear handle, an electrically powered drive motor being positioned within the interior of the housing the drive motor having rotation means;

a chain saw blade formed in a planar generally oval shaped configuration with a continuous outer edge, the blade being about eight and one half inches in length and about two and one half inches in height, a guide bar formed in a thin planar rectangular configuration and being slidably coupled around the outer edge of the blade, the blade being operatively coupled to the drive motor through the aperture in the housing, the rotation means of the drive motor causing the guide bar to revolve around the outer edge of the blade in an operative orientation; and a cutter chain consisting of parallel rows of cutter teeth, the teeth of each parallel row being offset with respect to each other, each of the teeth being formed in a generally trapezoidal configuration with a linear first end and an tooth second end, the linear first end of each of the teeth being coupled to the guide bar of the chain saw blade, a plurality of connecting shafts being formed in a planar configuration with coupling means at each end, the connecting shafts coupling adjacent teeth to each Other, the tooth second end including a cap having a diamond grid surface and front and rear edges which are beveled outwardly and upwardly to define a continuation of front and rear edges of the teeth, the diamond grid surface facilitating the cutting of mortar in an operative orientation, the width of each of the teeth being approximately one-eighth of an inch, the cutter blade being approximately one-quarter of an inch wide to permit users to easily cut through mortar positioned between bricks, the offset teeth preventing the blade from binding while in use.

* * * * *